US008871357B2

(12) United States Patent
Heinrichsdorff et al.

(10) Patent No.: US 8,871,357 B2
(45) Date of Patent: Oct. 28, 2014

(54) METHOD FOR GENERATING A CLOSED-PORE METAL FOAM AND COMPONENT WHICH HAS A CLOSED-PORE METAL FOAM

(75) Inventors: Frank Heinrichsdorff, Mahlow (DE); Jens Dahl Jensen, Berlin (DE); Ursus Krüger, Berlin (DE); Gabriele Winkler, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 56 days.

(21) Appl. No.: 13/700,850

(22) PCT Filed: May 19, 2011

(86) PCT No.: PCT/EP2011/058178

§ 371 (c)(1),
(2), (4) Date: Nov. 29, 2012

(87) PCT Pub. No.: WO2011/151193

PCT Pub. Date: Dec. 8, 2011

(65) Prior Publication Data

US 2013/0216743 A1 Aug. 22, 2013

(30) Foreign Application Priority Data

May 31, 2010 (DE) ..... 10 2010 022 598

(51) Int. Cl.

| | |
|---|---|
| ***H01F 3/00*** | (2006.01) |
| ***B22F 3/11*** | (2006.01) |
| ***C22C 1/08*** | (2006.01) |

(52) U.S. Cl.

CPC ..... *B22F 3/11* (2013.01); *B22F 3/1134* (2013.01); *C22C 1/08* (2013.01)

USPC ..... 428/566; 428/408; 428/615; 428/621; 428/35.8

(58) Field of Classification Search

USPC ..... 428/34.4, 408, 566, 615, 621, 35.8; 419/2

See application file for complete search history.

(56) References Cited

U.S. PATENT DOCUMENTS

| | | | | |
|---|---|---|---|---|
| 4,099,961 | A | 7/1978 | Patten | 75/415 |
| 5,151,246 | A | 9/1992 | Baumeister et al. | 419/2 |
| 2010/0012323 | A1 | 1/2010 | Holmes et al. | 166/300 |

FOREIGN PATENT DOCUMENTS

| | | | | |
|---|---|---|---|---|
| CN | 101711996 | A | 5/2010 | B01J 23/42 |
| DE | 4018360 | C1 | 5/1991 | B22F 3/11 |

(Continued)

OTHER PUBLICATIONS

International Search Report and Written Opinion, Application No. PCT/EP2011/058178, 14 pages, Oct. 14, 2011.

(Continued)

*Primary Examiner* — Michael C Miggins
(74) *Attorney, Agent, or Firm* — King & Spalding L.L.P.

(57) ABSTRACT

A method for generating a closed-pore metal foam and a component in which such a metal foam is used are provided. To form the metal foam having closed pores, the component is provided with a composite of metal particles that may have a layer of a blowing agent. Alternatively the metal and the blowing agent can also be arranged in layers of a sheet, or as a mixture of particles. A heat treatment is the applied whereby the blowing agent liberates a propellant gas, the blowing agent including fullerenes or nanotubes to which the blowing agent is chemically or physically bound. Due to the high temperature stability of the nanotubes or fullerenes, blowing agents may be thereby generated which liberate propellant gas at temperatures of above 1000 DEG C., such that even metals with high solidus temperatures of above 1000 DEG C. may be processed to metal foams.

14 Claims, 2 Drawing Sheets

(56) References Cited

FOREIGN PATENT DOCUMENTS

| | | | | |
|---|---|---|---|---|
| EP | 0460392 | A1 | 12/1991 | B22F 3/10 |
| JP | 2005171358 | A | 6/2005 | B22D 19/14 |
| JP | 2007154282 | A | 6/2007 | B22D 19/14 |
| JP | 4177244 | B2 | 11/2008 | B22D 19/14 |
| JP | 4402823 | B2 | 1/2010 | B22F 3/11 |
| WO | 01/05542 | A1 | 1/2001 | B22F 1/00 |
| WO | 2008/087214 | A1 | 7/2008 | A61F 2/30 |
| WO | 2008/145173 | A1 | 12/2008 | H01J 61/36 |
| WO | 2011/151193 | A1 | 12/2011 | B22F 3/11 |

OTHER PUBLICATIONS

Chinese Office Action, Application No. 201180026981.1, 17 pages, Feb. 17, 2014.

METHOD FOR GENERATING A CLOSED-PORE METAL FOAM AND COMPONENT WHICH HAS A CLOSED-PORE METAL FOAM

CROSS-REFERENCE TO RELATED APPLICATIONS

This application is a U.S. National Stage Application of International Application No. PCT/EP2011/058178 filed May 19, 2011, which designates the United States of America, and claims priority to DE Patent Application No. 10 2010 022 598.3 filed May 31, 2010. The contents of which are hereby incorporated by reference in their entirety.

TECHNICAL FIELD

The disclosure relates to a method for generating a closed-pore metal foam, in which a composite comprising a metal or a metal alloy and a blowing agent is provided. This composite is subjected to a heat treatment, the heating of the composite being sufficient for the blowing agent to form a blowing gas with closed pores being formed in the composite. This means that the closed pores are generated by the blowing gas being generated and trapped in the closed pores as they are formed.

The disclosure furthermore relates to a component which consists at least partially of a closed-pore metal foam.

BACKGROUND

A component having a closed-pore metal foam part and a method for its production is known, for example, from U.S. Pat. No. 5,151,246. The component may for example consist of a sleeve, in the interior of which the closed-pore metal foam is accommodated. Blowing agents, for example metal hydrides, in particular titanium hydride, or carbonates, for example calcium carbonate, are used in order to produce this closed-pore metal foam part. From these blowing agents and the metal which is intended to form the metal foam, a composite is produced, which may for example consist of particles of the two substances and which is compacted by pressing. The green body formed in this way can subsequently be subjected to a heat treatment, in which case the temperature must be high enough so that, on the one hand, bonding takes place between the individual powder particles of the metal and, on the other hand, the blowing agent forms a blowing gas. In order to ensure bonding between the metal particles, at least diffusion processes between the particles must be made possible. To this end, sufficient heating of the metal substance must be carried out. With said blowing agents, particles of metals which have a solidus temperature of up to 660° can be foamed.

Metal foams are used, for example, in order to seal housing structures. According to WO 2008/145173 A1, this is for example advantageous in the case of gas discharge lamps which are mounted in a lamp body. In order to permit electrical contacting, contacts must be fed out from the lamp body, in which case hermetic sealing of these feed-throughs must be ensured so that no oxygen enters the interior of the lamp. The feed-through between the lamp body and the metal electrode can be reliably filled by means of a metal foam.

Furthermore, the chosen blowing agent must be selected in terms of its thermal properties in such a way that it is compatible with the solidus temperature of the metal to be foamed (or of the metal alloy to be foamed). In this case, the temperature difference between the solidus temperature of the metal and the lower temperature, at which the blowing agent releases the blowing gas, must not be more than 120° C. Only in this way is it possible to ensure that a metal foam is formed reliably. When metal foams are referred to below, this is also meant to include foams of metal alloys.

SUMMARY

In one embodiment, a method for generating a closed-pore metal foam is provided, wherein a composite comprising a metal or a metal alloy and a blowing agent is provided, the composite is subjected to a heat treatment, the heating of the composite being sufficient for the blowing agent to form a blowing gas with closed pores being formed in the composite, and molecules of C and/or molecules of B and N, which have a spherical or tubular structure, are used as the blowing agent, the blowing gas being chemically or physically bound to these molecules.

In a further embodiment, the blowing agent is bound to the molecules by a functionalization of the latter or coating the latter. In a further embodiment, the functionalization of the molecules is carried out by bonding the functional group —COOMe, where Me is in particular Mo, Ni, Ir or Co. In a further embodiment, spherical molecules, in which the blowing gas is enclosed, are used as molecules. In a further embodiment, helium and/or nitrogen is enclosed in the molecules as blowing gas. In a further embodiment, the composite is formed from metal particles or metal alloy particles, at least some of these particles being coated with a coat of the blowing agent. In a further embodiment, the composite consists of a coat comprising a plurality of layers, successive layers of the metal or the metal alloy and of the blowing agent being provided. In a further embodiment, a material having a negative thermal expansion coefficient is additionally introduced into the composite.

In another embodiment, a component which consists at least partially of a closed-pore metal foam is provided, wherein molecules of C and/or molecules of B and N, which have a spherical or tubular structure, are contained in the metal foam.

In a further embodiment, the component is formed as a housing structure comprising a material which is different to the metal foam and comprises a cavity having an opening, which is closed by the metal foam. In a further embodiment, the cavity is formed by a glass body, in particular a lamp. In a further embodiment, a material having a negative thermal expansion coefficient is additionally provided in the metal foam, the proportion of which is selected in such a way that the metal foam has at least essentially the same expansion coefficient as the housing structure in the region of the opening.

BRIEF DESCRIPTION OF THE DRAWINGS

Example embodiments will be explained in more detail below with reference to figures, in which.

DETAILED DESCRIPTION

Figure 1:
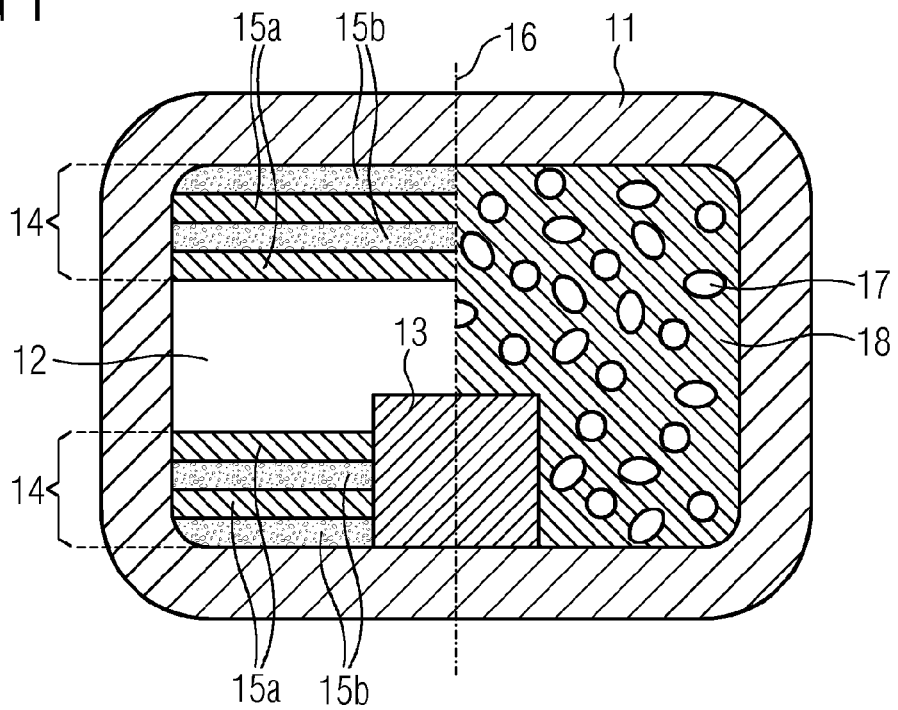
FIGS. 1 to 3 show exemplary embodiments of components in section, the states respectively before and after carrying out an exemplary embodiment of the method for the heat treatment (formation of the metal foam) respectively being represented schematically on the left and right of a dividing line.

Some embodiments provide a method for generating a closed-pore metal foam and a component comprising such a closed-pore metal foam, in which metals having a solidus temperature of more than 660° C. can be used.

In some embodiments, molecules of C and/or molecules of B and N, which have a spherical or tubular structure, are used as the blowing agent, the blowing gas being chemically or physically bound to these molecules. The spherical molecules are known, for example, as so-called fullerenes. These are regular structures, for example of C atoms. A particular example is the fullerene denoted as $C_{60}$, the structure of which resembles a soccer ball. As tubular structures, carbon nanotubes (abbreviated to CNT below) or boron nitride nanotubes (referred to below as BNNT) are known. Chemical binding of the blowing agent may, for example, be carried out by functionalization of these molecules. A functional group which is suitable as a blowing agent is, for example, —COOMe. This group may for example be bound to a C atom of a CNT, Me standing in particular for Mo, Ni, Ir or Co. The blowing agent obtained in this way reacts in the presence of a reaction partner such as $O_2$ in a temperature range in excess of 1000° C. $CO_2$ is typically released in this case, which then acts as a blowing gas. With this example of a blowing agent, metals which have a solidus temperature of more than 1000° can thus be processed to form foams.

It is also possible for the blowing agent to be bound to the molecules by coating the latter. In this case, very thin coats having a thickness of one or more atomic layers are applied for example by an ALD method (ALD stands for atomic layer deposition). In this case, the nanoparticles are kept in motion by a turbulent flow method. This method is already known. The particles to be coated may, for example, be CNTs or BNNTs. Typically, these molecules may be coated with titanium hydride or noble-metal oxides, for example iridium oxide and/or molybdenum oxide and/or platinum oxide and/or copper (I) oxide and/or magnetide and/or vanadium pentoxide. The use of noble-metal oxides is advantageous since, owing to their low affinity for oxygen, they decompose more readily into the metal component and an oxygen component, which provides the blowing agent. This is done at temperatures which are of interest for the formation of metal foams. For example, iridium oxide and platinum oxide decompose at temperatures of around 1200° C., ruthenium oxide and rhodium oxide at temperatures of approximately 1100° C. and molybdenum oxide likewise at 1100° C. Oxides having even higher decomposition temperatures are magnetide with a decomposition temperature of 1580° C., copper (I) oxide with a decomposition temperature of 1800° C. and vanadium pentoxide with a decomposition temperature of 1750° C. The oxides can therefore be selected suitably according to the solidus temperature of the metal used for the foaming, in which case it is necessary to take into account the fact that the decomposition temperature of the selected metal oxide must be lower than the relevant solidus temperature of the metal used, specifically by up to 120° C.

If spherical molecules are used as the molecules, then according to some embodiments the blowing gas may also be enclosed in these molecules, i.e. may already exist as a blowing gas at room temperature. However, it will not be released until the spherical molecules are broken down. To this end, they need to be heated to 1500° C. Gas-filled fullerenes may for example contain He or $N_2$, these being referred to as He@C60 or $N_2$@C60. When the gas is released from the interior of the fullerenes, after decomposition of the latter it is available as a blowing gas. This means that even metals having a solidus temperature of about 1600° C. can be foamed with such blowing agents.

According to another embodiment, the composite is formed from metal particles or metal alloy particles, at least some of these particles being coated with a coat of the blowing agent. In this case, even before the metal particles are processed to form a component (green compact), the blowing agent is thus already packaged in such a way that the blowing agent is already incorporated into the green compact during production of the green compact. The concentration of the blowing agent can be adjusted by the thickness of the coating on the particles, the particle size and/or the proportion of coated particles in relation to uncoated particles. This advantageously provides a very accurate method for adjusting the blowing agent concentration. The concentration of the blowing agent subsequently dictates the size and the concentration of pores in the metal foam, and therefore also its density.

Another embodiment is obtained when the composite consists of a coat comprising a plurality of layers, successive layers of the metal or the metal alloy and of the blowing agent being provided. It is particularly advantageous for layers of the blowing agent and layers of the metal alloy, or of the metal, to alternate with one another. The concentration of blowing agent can be adjusted by the thickness ratio of the metal coats to the blowing agent coats. The layers must, however, be made thin enough that uniform distribution of the blowing gas in the composite can take place, so that uniform distribution of the pores in the foam being formed also takes place. In this way, components having particularly large surfaces can advantageously be coated very economically with coats of a metal foam.

It is particularly advantageous for a material having a negative thermal expansion coefficient additionally to be introduced into the composite. This may for example, as already explained above for the blowing agent, be carried out by coating particles or providing layers of this material between other layers of the metal, or of the blowing agent. If materials having a negative thermal expansion coefficient are provided in the metal foam, it is thereby possible to influence the thermal expansion coefficient of the metal foam, which is reduced by means of this. A prerequisite, however, is that the material is thermally stable enough for it to withstand the heat treatment necessary for the formation of the metal foam.

The thermal expansion coefficient of the metal foam reduced by the material is advantageous in particular when the metal foam is brought in contact with components that have a lower thermal expansion coefficient than the metal foam without the part comprising the material having the negative thermal expansion coefficient. For example, metal foams can advantageously be bonded reliably to ceramic components or vitreous components by this measure. The bond between the corresponding component and the metal foam is exposed to less mechanical stresses by matching the thermal expansion coefficients of the metal foam and the component. In particular, this can make it possible for a sealing bond to be formed reliably and over a prolonged period of time between the metal foam and the component.

The object is furthermore achieved by a component in which molecules of C and/or molecules of B and N, which have a spherical or tubular structure, are contained in the metal foam used. This is because these molecules are suitable in the manner indicated above for physically or chemically binding a carrier gas which is then contained in the pores of the metal foam. Specifically, in the manner described above, the substances of the blowing agent are bound to the molecules, and the carrier gas which has formed the pores of the metal foam is released by a heat treatment.

According to an advantageous embodiment of the component, it is formed as a housing structure comprising a material which is different to the metal foam and comprises a cavity having an opening, which is closed by the metal foam. Hermetic sealing of the cavity is advantageously possible in this case, since an intimate bond is formed between the metal foam and the housing structure in the region of the opening. In particular when the metal foam is matched in terms of its thermal expansion coefficient to that of the housing structure in the manner indicated above, hermetic sealing can advantageously be ensured over a prolonged period of time even when the component is thermally stressed. This is particularly advantageous when the cavity is formed by a glass body, in particular a lamp.

A component having a housing structure 11 according to FIG. 1 comprises a cavity 12, in which case the component may for example be a tube which is open at both ends. A copper conductor 13 furthermore extends through the component, the rest of the cross section of the cavity 12 being intended to be sealed. To this end, coats 14 (represented in the half to the left of the dividing line 16), which comprise alternating layers 15*a* of a metal and 15*b* of a blowing agent, are applied onto the inner walls of the housing structure 11. The layers 15*a*, 15*b* are represented with an unrealistic thickness in FIG. 1. Of course, thinner layers and a substantially larger number thereof may be provided. These layers may for example be applied by cold gas spraying, by electrochemical coating or alternatively by an ALD method (ALD stands for atomic layer deposition).

Not represented is the possibility of providing further layers, which consist of materials having a negative thermal expansion coefficient, in the composite. For example, $ZrW_2O_5$, $ZrV_2O_7$, $Sc_2W_3O_{12}$, $Y_2W_3O_{12}$, $K_5Zr(PO_4)_2$ or $KzR_2(PO_4)_3$ are known as such materials.

In the right-hand half of the representation according to FIG. 1, i.e. on the right of the dividing line 16, the finished metal foam 18 is represented. It comprises pores 17, the metal foam fully filling the cavity 12. The metal foam in this case bears both on the copper conductor 13 and on the inner wall of the cavity 12, so that a hermetic seal is formed.

The value of the concentration of pores 17 in the metal foam 18 depends on the concentration of the blowing agent. In FIG. 1 (as well as in the other figures), the pores are merely represented by way of example. The concentration of the pores may in reality be very much greater, so that merely comparatively thin-walled metallic structures are formed between them. In this way, in particular, it is possible to achieve a sealing structure having a low density.

Figure 2:
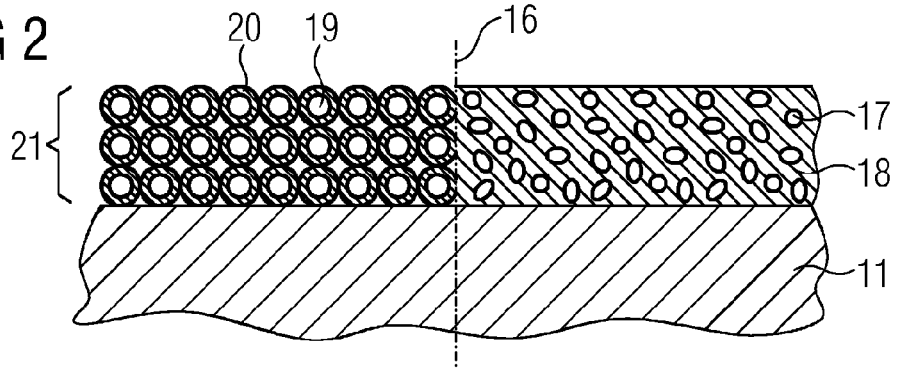

In the case of the housing structure 11 according to FIG. 2, metal particles, all of which have a coat 20 of the blowing agent, are applied onto the surface. Not represented is a variant according to which only some of the particles 19 have such a coat, so that a mixture of coated and uncoated particles 19 would be formed. After a heat treatment in accordance with the disclosed method, a closed-pore metal foam 18 is formed by the generation of a blowing gas from the coat 20 of the blowing agent, this foam being represented on the right of the dividing line 16.

Figure 3:
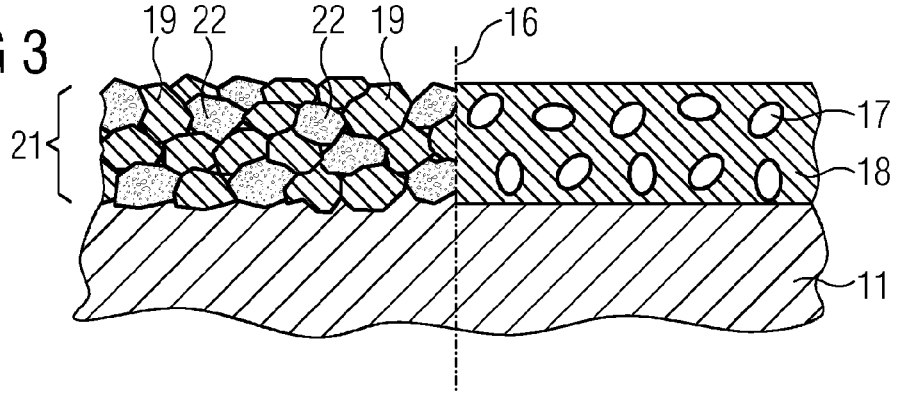

According to FIG. 3, the composite 21 is formed from different particles, namely the metal particles 19 and blowing agent particles 22, which are mixed together (see on the left of the dividing line 16). Here as well, a heat treatment generates the metal foam 18 comprising the pores 17, which is represented on the right of the dividing line.

Figure 4:
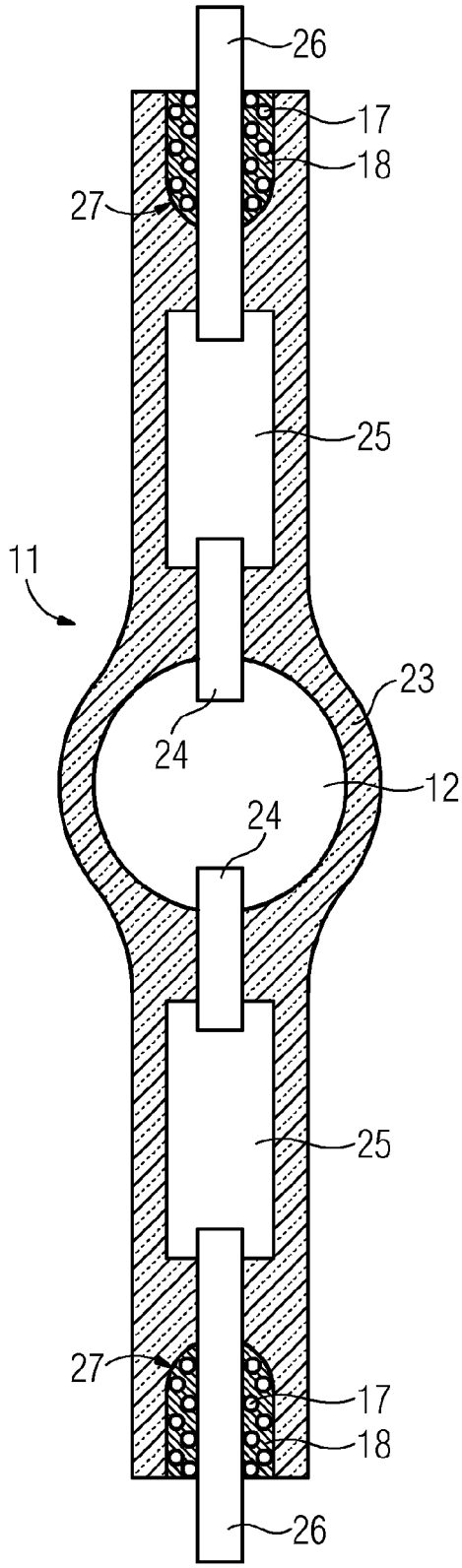
FIG. 4 shows a lamp body having sealed feed-throughs for contacting, the seal being formed by an exemplary embodiment of the metal foam.

According to FIG. 4, a glass body 23 for a gas discharge lamp is represented as the component which forms the cavity structure 11. In the cavity 12, there are two electrodes 24 which are connected by means of flat conductors 25, located in pinch seals, to connection contacts 26. The connection contacts 26 are fed through openings 27, so that contacting from the outside is possible. These openings 27 are filled with the metal foam 18 in the manner disclosed herein, in order to ensure hermetic sealing of the contact feed-throughs in the openings 27.

What is claimed is:

1. A method for generating a closed-pore metal foam, comprising:

providing a composite comprising a metal or a metal alloy and a blowing agent comprising blowing agent molecules, the blowing agent molecules having a spherical or tubular structure and comprising at least one of (a) C molecules and (b) B and N molecules, and subjecting the composite to a heat treatment in which the heating is sufficient for the blowing agent to at least one of (a) form a blowing gas and (b) release a blowing gas present in the blowing agent molecules prior to the heat treatment, such that the heat treatment forms closed pores in the composite, wherein the blowing gas is chemically or physically bound to the blowing agent molecules.

2. The method of claim 1, wherein the composite is formed from metal particles or metal alloy particles, at least some of these particles being coated with a coat of the blowing agent.

3. The method of claim 1, wherein prior to the heat treatment, the composite consists of a coat comprising alternating layers of the metal or the metal alloy and the blowing agent.

4. The method of claim 1, comprising introducing a material having a negative thermal expansion into the composite.

5. The method of claim 1, wherein the blowing gas is bound to the blowing agent molecules by a functionalization of the latter or coating the latter.

6. The method of claim 5, wherein the functionalization of the blowing agent molecules is carried out by bonding the functional group —COOMe, where Me represents Mo, Ni, Ir or Co.

7. The method of claim 1, wherein the blowing agent molecules comprise spherical molecules in which the blowing gas is enclosed.

8. The method of claim 7, wherein at least one of helium and nitrogen is enclosed in the spherical blowing agent molecules.

9. A component configured for generation of a closed-pore metal foam as in the component upon a heat treatment, the component comprising:

a housing structure comprises a cavity defining an interior surface and having an opening; and a coating formed on the interior surface of the housing structure cavity, the coating comprising one or more layers of a metal or metal alloy and one or more layers of a blowing agent comprising blowing agent molecules, the blowing agent molecules having a spherical or tubular structure and comprising at least one of (a) C molecules and (b) B and N molecules, the coating configured such that upon a defined heat treatment, the blowing agent at least one of (a) form a blowing gas and (b) release a blowing gas present in the blowing agent molecules prior to the heat treatment, such that the heat treatment forms a metal foam having closed pores formed therein.

10. The component of claim 9, wherein the coating formed on the interior surface of the housing structure cavity further comprises a material having a negative thermal expansion coefficient.

11. The component of claim 9, wherein the cavity is formed by a glass body.

12. The component of claim 11, wherein the glass body comprises a lamp.

13. The component of claim 9, wherein the blowing agent molecules comprise spherical molecules in which the blowing gas is enclosed.

14. The component of claim 13, wherein at least one of helium and nitrogen is enclosed in the spherical blowing agent molecules.

* * * * *